US008672241B2

(12) United States Patent
Wurz

(10) Patent No.: US 8,672,241 B2
(45) Date of Patent: Mar. 18, 2014

(54) MULTI-HOLE OR CLUSTER NOZZLE

(76) Inventor: Dieter Wurz, Baden-Baden (DE)

( * ) Notice: Subject to any disclaimer, the term of this patent is extended or adjusted under 35 U.S.C. 154(b) by 412 days.

(21) Appl. No.: 12/733,715

(22) PCT Filed: Sep. 16, 2008

(86) PCT No.: PCT/EP2008/007722
§ 371 (c)(1),
(2), (4) Date: Mar. 16, 2010

(87) PCT Pub. No.: WO2009/036947
PCT Pub. Date: Mar. 26, 2009

(65) Prior Publication Data

US 2010/0219268 A1 Sep. 2, 2010

(30) Foreign Application Priority Data

Sep. 17, 2007 (DE) ..... 10 2007 044 272

(51) Int. Cl.

| | |
|---|---|
| ***B05B 1/06*** | (2006.01) |
| ***B05B 1/14*** | (2006.01) |
| ***B05B 1/28*** | (2006.01) |
| ***B05B 1/34*** | (2006.01) |
| ***B05B 7/00*** | (2006.01) |

(52) U.S. Cl.
USPC ..... 239/558; 239/290; 239/242; 239/242.5; 239/429; 239/433; 239/490; 239/491; 239/493; 239/590.5

(58) Field of Classification Search
USPC ..... 239/290, 418, 423, 424, 424.5, 425, 239/428, 429, 432, 433, 434.5, 463, 469, 239/470, 472, 474, 475, 490, 491, 493, 548, 239/558, 559, 589, 590.5, 601
See application file for complete search history.

(56) References Cited

U.S. PATENT DOCUMENTS

| | | | | |
|---|---|---|---|---|
| 2,942,790 | A * | 6/1960 | Starkey et al. | 239/405 |
| 4,203,717 | A * | 5/1980 | Facco et al. | 431/182 |
| 5,372,312 | A * | 12/1994 | Vidusek | 239/419.3 |
| 5,944,507 | A * | 8/1999 | Feldermann | 431/189 |
| 2004/0061001 | A1 * | 4/2004 | Mao et al. | 239/398 |
| 2005/0284957 | A1 * | 12/2005 | Haruch | 239/290 |

FOREIGN PATENT DOCUMENTS

| | | | | |
|---|---|---|---|---|
| DE | 10 2006 009 147 | A1 | 8/2007 | |
| EP | 1 402 956 | A2 | 3/2004 | |
| FR | 2 454 837 | | 11/1980 | |
| FR | 2 815 552 | | 4/2002 | |
| JP | 01-123012 | | 5/1989 | |
| JP | 2000-254554 | | 9/2000 | |
| WO | WO 2007098865 | A1 * | 9/2007 | B05B 7/04 |

OTHER PUBLICATIONS

International Search Report from Application No. PCT/EP2008/007722 dated Dec. 19, 2008 with English Translation of Categories of Documents (6 pages).

* cited by examiner

*Primary Examiner* — Darren W Gorman
(74) *Attorney, Agent, or Firm* — Flynn, Thiel, Boutell & Tanis, P.C.

(57) ABSTRACT

A multi-hole or cluster nozzle having several outlet openings for fluid to be atomized. The central longitudinal axes of at least two of the outlet openings are aligned askew relative to one another, where a distance between the central longitudinal axes of these outlet openings and the main longitudinal axis of the nozzle is initially reduced when seen in the outflow direction, without intersecting the central longitudinal axis, and increases again after passing through a minimum distance. Use for example in nozzles for evaporative cooling or for flue gas cleaning.

15 Claims, 4 Drawing Sheets

MULTI-HOLE OR CLUSTER NOZZLE

FIELD OF THE INVENTION

The invention relates to multi-hole or cluster nozzles having several outlet openings for a fluid to be atomized.

Multi-hole nozzles are nozzles in which the droplet spray exits via several individual holes from a common pre-chamber or mixing chamber.

Cluster nozzles are nozzles in which several individual nozzles functional in principle are fitted to a nozzle head or inside a nozzle head.

Multi-hole nozzles and cluster nozzles have in common that several spray jets exit simultaneously from the nozzle and form a total outlet jet. An interaction or mixing of individual jets can take place inside the total outlet jet, but not necessarily so. The invention therefore relates to nozzles for atomization of liquids without and with the use of compressed air, where alternatively several individual nozzles are fitted to a nozzle lance head, or liquid or a droplet/gas mixture flows out of a common chamber from several outlet openings inside the nozzle outlet part. It is intended with the invention to use new measures for creating a fine droplet spray while avoiding deposits on the nozzle outlet part in these multi-hole or cluster nozzles.

BACKGROUND OF THE INVENTION

In many process engineering facilities, liquids are sprayed into a gaseous fluid, e.g. into a flue gas to be cleaned or cooled, hence for flue gas cleaning or for evaporative cooling. It is frequently of crucial importance here that the liquid is atomized into the finest possible droplets. The finer the droplets, the larger the specific droplet surface. Considerable process engineering advantages can be obtained as a result. For example, the size of a reaction vessel and its manufacturing costs depend crucially on the mean droplet size. But in many cases it is in no way sufficient for the mean droplet size to fall below a certain limit value. Even a few considerably larger droplets can cause considerable disruptions in operation. This is particularly the case when the droplets do not evaporate quickly enough due to their size, so that droplets or even doughy particles are deposited in the following components, e.g. onto fabric filter hoses or onto fan blades, leading to operating disruptions due to incrustation, corrosion or imbalance.

If liquids are to be atomized to a finest possible droplet spray, not only high-pressure single-fluid nozzles only loaded with the liquid to be atomized are used, but also and frequently so-called compressed-gas-assisted dual-fluid nozzles. In these nozzles, the liquid is sprayed with the aid of a compressed, gas, e.g. compressed air or compressed steam as the first gaseous fluid, into a second gaseous fluid, e.g. into flue gas.

Definitions

In the interests of linguistic simplification, the following will use in many cases the designation "compressed air" to designate the first gaseous fluid, with the designation "compressed air" including the use of compressed gas or compressed steam with substantially any required chemical composition. Furthermore, the second gaseous fluid is as a rule referred to as flue gas, the use of the designation "flue gas" including any other gaseous fluid that is possibly solids-laden in addition.

The description of the invention concentrates on the complicated case of the compressed-air-assisted dual-fluid nozzle. The invention is however also applicable to single-fluid pressurized atomizer nozzles, provided the latter are designed as multi-hole or cluster nozzles.

Operational Problems in Nozzles, and Weaknesses of Laboratory Testing:

Together with the energy consumption required for atomization, the characteristic of the created droplet spray is of crucial importance. In this connection, the following problems must be mentioned: the measurement of the droplet distribution in the spray created with a nozzle generally takes place under ideal boundary conditions in fluid mechanics laboratories. The boundary conditions prevailing in large technical facilities are in some cases considerably falsified as a result; for example, the dust content of the flue gas and the loading of the flue gas with easily condensable gases is not simulated in the laboratory. For that reason, the results obtained in the laboratory can only be transposed to a limited extent onto long-term operation in large systems. The easily condensable gaseous constituents of flue gas are in particular sulphur trioxide or sulphuric acid. But in the absence of sulphuric acid, falling below the steam dewpoint can already lead to considerable problems with deposit formation. While the sulphuric acid dewpoint temperature can for example be between 100° C. and 160° C., the steam dewpoint temperatures in flue gases can frequently be between about 45° C. and 65° C. Since with dual-fluid nozzles a comparatively cold fluid is sprayed into the flue gas as a rule, the surface temperature of the nozzle lance and the nozzle head, in particular also that of cluster nozzle heads, is considerably lower than the dewpoint temperatures of the stated flue gas constituents. Liquid condensing from the flue gas at the nozzle lance and nozzle head can chemically react with the particulate constituents of the flue gas, the airborne dusts. It is thus easy to see that airborne dusts with a high quicklime (CaO) content react with the flue gas's sulphur trioxide content condensing as sulphuric acid ($H_2SO_4$) to form gypsum ($CaSO_4$), so that hard and firmly adhering deposits can build up. But if the steam dewpoint is not reached at the lance or nozzle surface, not even a sulphuric acid content of the flue gas is required. Even a low sulphur dioxide content is sufficient for the buildup of hard deposits if the airborne dusts contain CaO or MgO, for example. A deposit formation is also possible if only steam is condensed and the condensate sets with deposited airborne dusts.

If however deposits grow in the area of the nozzle outlet openings, it can hardly be avoided that droplets from the spray are deposited onto these deposits and that liquid films form here, as is described in more detail in the discussion of FIG. 1. Comparatively large secondary droplets separate from these liquid films in the range of low shear tension forces. Whereas with a modern dual-fluid nozzle maximum droplet sizes of, for example, 20 to 100 μm are obtainable in principle, the droplets separating from the liquids films can easily have diameters of 500 to 3000 μm. For droplets of such a size, the dwell time even in large technical facilities is much too short even for an only approximately complete evaporation to succeed. Inadmissibly high moisture contents of the product reaching the following components of the facility can result. The insidious thing here is that the deposits on the nozzle head generally only after some time develop sufficiently to exert any severely disruptive influence on the droplet size distribution. Whereas very good results are obtained in a system fitted with new nozzles, over time the operation can be considerably impaired once the deposits have grown thicker.

There is therefore considerable interest in largely preventing deposits on nozzle lances in the close vicinity of nozzles and on the nozzles themselves.

In the case of nozzles with a single outlet hole, deposits can be prevented in a known way using a sheath air device, see for example the international patent publication WO 2007/098865 (PCT/EP 2007/001384). In this case, air is passed with a comparatively low primary pressure, e.g. about 40 mbar, to the nozzle head through a sheathing tube enclosing the actual nozzle lance, and placed around the droplet jet exiting from the nozzle at a comparatively low speed as a sheath air jacket shielding against the flue gas. A deposit formation at the individual nozzle hole can thus be largely ruled out. Even on the nozzle lances, deposit formation is largely suppressed. The latter can be attributed to the fact that the sheath air layer in the outer pipe represents a thermal insulation from the cold nozzle lance, so that the outer skin of the sheathing tube takes on approximately the flue gas temperature, thus preventing any dew formation by flue gas constituents in most cases.

In conventional nozzles with several outlet holes or in the case of cluster nozzles, the supply of the nozzle head area with sheath air causes major problems, as is explained in the following. In such nozzles according to the prior art, the distance between the individual passage openings is very large, as can be seen for example in FIGS. 1 and 2. Every single nozzle acts as a jet pump: it sucks in gaseous fluid, e.g. flue gas, from the environment and mixes it into the spray jet. This gaseous fluid thus flows partly over the cold front surface of the nozzle towards the passage opening, and accordingly the growth of deposits is possible here, at any rate when the gaseous fluid is flue gas. But even if no flue gas reaches the cold front surface of the nozzle, deposit formation can result over time. In this case, the deposits are created from the constituents of the liquid to be atomized itself. This is as a rule not a solids-free liquid, for example fully demineralized and microfiltered water, but process make-up water contaminated with dissolved substances. As shown in FIG. 1, recirculation vortices 17 can be generated by the nozzle jet and return small droplets to the front surface of the nozzle. If the liquid has an opportunity to evaporate here, even if only partly, the constituents automatically grow as deposits.

For a nozzle with several outlet holes, this is shown for example in FIG. 1, which also shows the liquid film 12 on the deposit and also the large secondary droplets 13 created. The critical factor in such nozzles with several outlet holes is in particular the central area, which frequently has no outlet hole for design reasons. A first step to improve the boundary conditions would thus be to revise the design of a multi-hole nozzle to the effect that a central outlet hole is possible. By arranging a sheath air nozzle according to the prior art, the deposit formation from flue gas constituents can be prevented in such nozzles with several outlet holes. However, a relatively large sheath air volume flow is required if a deposit formation on the front surface of the nozzle is to be dependably thwarted. It is of course not desirable to supply an unnecessarily large amount of sheath air to the nozzle jet, since it is of course not the sheath air but the flue gas which is to be cooled by droplet evaporation. There is thus a strong interest in keeping the nozzle front surface susceptible to deposit formation as small as possible and to reduce as far as possible the distance between the individual nozzle outlet holes. In the case of nozzles according to the prior art this is not possible, since for this purpose the outlet holes must be arranged closely around the central axis, as shown in FIG. 1. Then however the inflow to these nozzle holes is very unfavourable and involves high pressure losses and flow separation in the outlet holes, and an unsatisfactory atomization.

The situation with cluster nozzles according to the prior art is even more critical, as shown in FIG. 2. Here it would be necessary to work with a very large amount of sheath air and with a sheath air nozzle head of complex design if a deposit formation from flue gas constituents is to be reliably prevented. A deposit formation from the solids content of the liquids to be atomized cannot yet however be prevented with this.

SUMMARY OF THE INVENTION

The invention is intended to provide a multi-hole or cluster nozzle in which a deposit formation is at least greatly reduced and which permits the generation of a total spray jet with a wide spray angle.

In accordance with the invention, a multi-hole or cluster nozzle with several outlet openings for fluid to be atomized is provided for this purpose, in which the central longitudinal axes of at least two of the outlet openings are aligned askew relative to one another, where a distance between the central longitudinal axes of these outlet openings and the main longitudinal axis of the nozzle is initially reduced when seen in the outflow direction, without intersecting the central longitudinal axis, and increases again after passing through a minimum distance.

Thanks to the invention, a convergent/divergent arrangement of the outlet jets is achieved, so that on the one hand the outlet holes of nozzles having several outlet openings or of cluster nozzles can be grouped as close as possible around the axis of the nozzle head and on the other hand the possibility is created of obtaining a total spray jet with a sufficiently wide spray angle. The nozzle configuration in accordance with the invention furthermore has only a low sheath air requirement. The minimum distance of the central longitudinal axes of the outlet openings of the individual nozzles is in the mouth area of the overall nozzle, and can therefore be arranged still in the mouthpiece upstream of the outlet openings, at the level of the outlet openings, or downstream of the outlet openings. In this case an area of minimum distance immediately downstream of the outlet openings is preferred, in order to achieve shortly after the nozzle a widening of the total jet.

Thanks to the convergent/divergent arrangement of the individual outlet jets, the outlet jets exiting from the individual nozzle holes or from the individual nozzles thus form in the mouth area of the overall nozzle a flow focus, where said flow focus can also be located inside this mouthpiece. The term "flow focus" should not be regarded in the narrower sense, but in the sense of a minimum cross-section of the total jet, where a larger cross-section of the total jet prevails upstream and downstream of this minimum cross-section.

The underlying idea of the invention is thus to align the individual nozzle jets or outlet jets such that the jet concentration forms to some extent a flow focus at the entry into a process area into which spraying takes place. The individual nozzle jets or outlet jets run in an inclined course towards the main axis or central longitudinal axis of the nozzle even before the flow focus or the minimum cross-section is reached, but are not strictly aligned to this central longitudinal axis, instead aiming past the central longitudinal axis in the centre. Here the centre of the total jet can be formed by the outlet jet of a central nozzle aligned parallel to the central longitudinal axis.

In an embodiment of the invention, the at least two outlet openings are arranged in a ring around the central longitudinal axis of the nozzle.

In this way, a compact arrangement of the outlet openings is achieved and in the case of a circular arrangement for example of the outlet openings a rotation-symmetrical total spray jet can be generated. For adapting the shape of the total spray jet to given geometrical conditions, for example, it is for example also possible to achieve ring configurations in elliptical or triangular form.

In an embodiment of the invention, the central longitudinal axes of the at least two outlet openings are, when seen on a plane containing the main longitudinal axis of the nozzle, arranged on the nozzle at the same angle to the main longitudinal axis.

In an embodiment of the invention, the central longitudinal axes of the at least two outlet openings are inclined in the same direction around the main longitudinal axis of the nozzle relative to a circumferential direction.

In this way, a twist can be imparted to the total spray jet.

In an embodiment of the invention, the central longitudinal axes of the at least two outlet openings are on the outer surface of an imaginary rotation hyperboloid.

Thanks to these measures, a rotation-symmetrical total spray jet can be generated and have a twist imparted to it about the central longitudinal axis of the nozzle.

In an embodiment of the invention, the nozzle jets generated by the at least two outlet openings can spread out largely without interaction between them in a process area downstream of the outlet openings.

In this way it can be achieved that the droplet sizes in the total spray jet are substantially independent of collision processes between individual droplets and are determined exclusively by the atomization properties of the individual nozzles or of the individual outlet openings.

In an embodiment of the invention, a central outlet opening on the main longitudinal axis of the nozzle is provided, about which opening the at least two further outlet openings are arranged in a ring.

Advantageously, in a nozzle of this type with central outlet opening the central longitudinal axes of the at least two further outlet openings are inclined in the same direction relative to a circumferential direction about the main longitudinal axis of the nozzle in order to generate a twist around the main longitudinal axis of the nozzle.

In an embodiment of the invention, an annular gap nozzle surrounding the outlet openings and subjected to compressed air is provided.

The provision of an annular gap nozzle is advantageous for preventing liquid films in the area of the nozzle mouth that can lead to secondary droplets of considerable size. The annular gap nozzle can be subjected to compressed air at high pressure or also, to generate sheath air, only with sheath air at low pressure.

In an embodiment of the invention, the outlet openings are provided inside a nozzle mouthpiece surrounded by an annular gap nozzle.

With a design of this type, the outlet openings are for example provided as holes inside a solid nozzle mouthpiece. This nozzle mouthpiece can be surrounded by an annular gap nozzle to prevent the creation of large secondary droplets.

In an embodiment of the invention a nozzle support element is provided on which are arranged several individual nozzles projecting from the nozzle support element in the outflow direction, where the individual nozzles are surrounded at least at the level of their outlet openings by an annular gap nozzle hood, such that an annular gap is formed between the individual nozzles and the annular gap nozzle hood at the level of the outlet openings.

Advantageously, it can be provided with a design of this type for the nozzle that a central nozzle with an outlet opening on the main longitudinal axis of the nozzle and at least two further individual nozzles surrounding in annular form the main longitudinal axis of the nozzle are provided, where an end face of the annular gap nozzle hood has one or more annular gap openings, such that at the level of the outlet openings a distance between an outer circumference of the individual nozzles and the annular gap opening(s) or the outer circumference of adjacent individual nozzles is substantially identical.

In this way, it is possible to achieve an approximately constant annular gap width of the annular gap nozzle thanks to an annular gap opening inside the annular gap nozzle hood designed for example in the shape of a star with rounded points or if necessary also irregularly designed. However, an annular gap between the housings of the individual nozzles also then has a substantially constant annular gap width, so that approximately the same flow speed of the annular gap air is achieved substantially over the entire annular gap, which can have a geometrically irregular shape. If cylindrical housings of the individual nozzles are adjacent to one another, a constant annular gap width can only be achieved approximately or not at all. If necessary, a restrictor element can be provided upstream of the annular gap in the cavity between the individual nozzles or the inside the annular gap nozzle hood in order to reduce the pressure in the annular gap air in a suitable manner.

In an embodiment of the invention, the annular gap nozzle is surrounded by an annular sheath air nozzle.

In this way, the annular gap nozzle can also be shielded from flue gases in the process chamber in the area of the nozzle mouth.

In an embodiment of the invention, a nozzle support element is provided on which are arranged several individual nozzles projecting from the nozzle support element in the outflow direction, where the individual nozzles are arranged on a front side of the nozzle support element that is generally concave when viewed in the outflow direction.

In this way, the convergent/divergent arrangement of the outlet jets of the individual nozzles or the appropriate associated alignment of the individual nozzles can be achieved by the shaping of the nozzle support element. Not only a curved front side is regarded as a concave front, but also for example a front surface comprising several flat part-surfaces forming overall a depression.

In an embodiment of the invention, the outlet openings are provided in a nozzle mouthpiece, where the nozzle mouthpiece has a basic element with conical outer surface and a hood surrounding the basic element and contacting in some sections its outer surface, and where the basic element and/or the hood have nozzle channel grooves ending at the outlet openings.

In this way, the nozzle channels in the arrangement in accordance with the invention can be achieved in simple manner by milling grooves into the conical basic element and/or the hood. After fitting the hood onto the basic element, the grooves are then closed on their open sides and form the nozzle channels. The grooves are for example provided on the conical basic element as in the manufacture of a helically-toothed bevel gear.

BRIEF DESCRIPTION OF THE DRAWINGS

Further features and advantages of the invention are shown in the claims and the following description of preferred embodiments of the invention in conjunction with the drawings. Individual features of the embodiments shown and described can be combined with one another in any way without going beyond the scope of the invention. The drawings show in:

Figure 1:
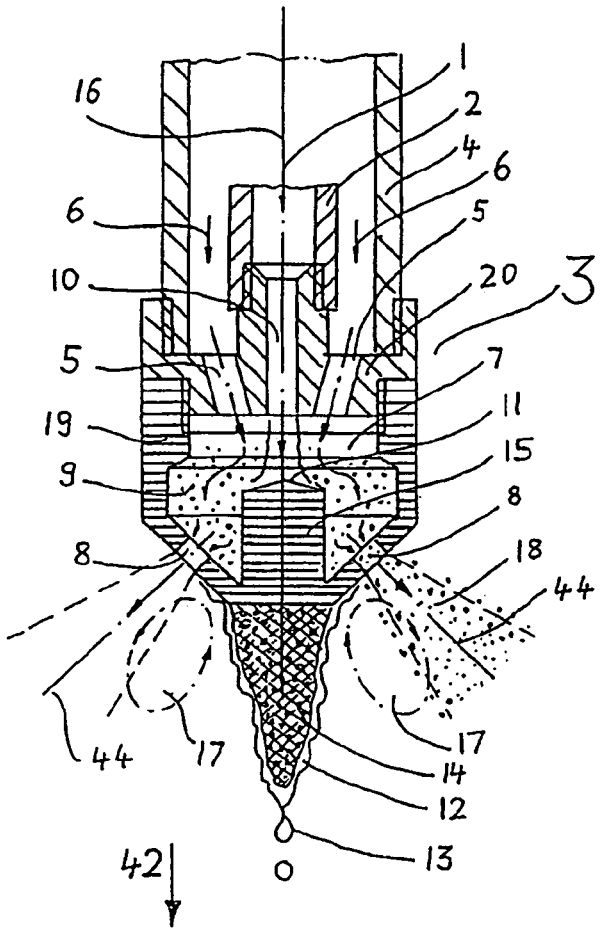
Prior Art Fig. 1
FIG. 1 a sectional view of a multi-hole nozzle according to the prior art.
Figure 2:
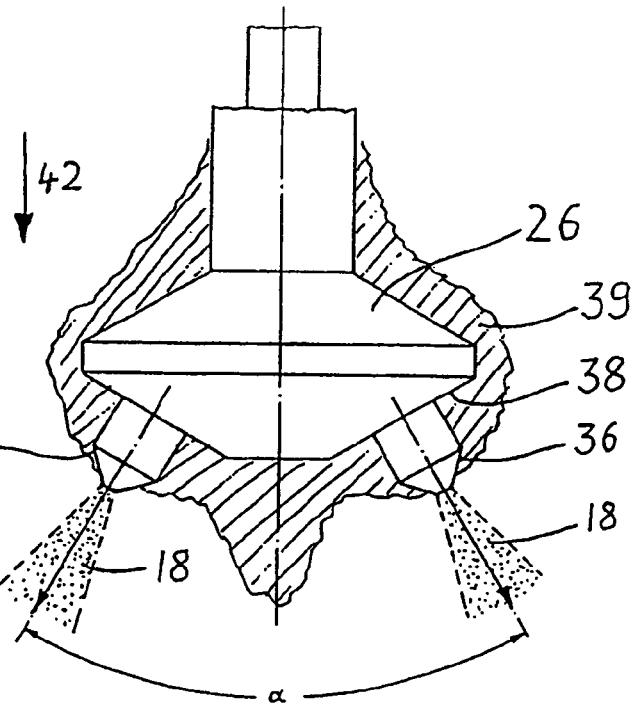
Prior Art Fig. 2
FIG. 2 a greatly simplified side view of a cluster nozzle according to the prior art.

The illustration in FIG. 1 indicates along general lines the prior art and shows a multi-hole nozzle 3 with a symmetry axis 16 and comprising a supply pipe 2 for the fluid 1 to be atomized, a supply pipe 4 for the compressed gas or compressed air 6, an inlet part 20 for liquid 1 and compressed gas 6 into the mixing chamber 7 with a hole 10 for liquid supply 1 and several holes 5 for the compressed air feed 6. Inside the mixing chamber 7 is arranged an anvil 15 with a baffle surface 11 at which liquid entering through the hole 10 is already split into relatively small droplets. This primary droplet spray is conveyed by the compressed air to the outlet holes 8. Due to the steep pressure drop and acceleration downstream of the outlet holes 8, the medium-sized droplets 9 created in the mixing chamber 7 are split into substantially smaller droplets. The compressed gas-conveyed droplet jets 18 exit from the holes 8. Inside the jet core are very fine droplets, whereas at the edge of the jet comparatively large droplets occur and stem from the deterioration of liquid films on the walls in the holes 8, in particular at the hole rims, in any event whenever no annular gap air is provided. A central solid deposit 14 has formed at the nozzle. Thanks to the recirculation vortex 17, smaller droplets are deposited on the central deposit 14 and here form a liquid film 12. At the nose tip 21 of the solid deposit 14, very large secondary droplets 13 come away from the liquid film.

The illustration in FIG. 1 shows in greatly simplified form the outer configuration of a cluster nozzle 26 according to the prior art. In cluster nozzles according to the prior art, the individual nozzles 36 are fitted on the front surface 38 of an outwardly curved cone, i.e. convex when seen in the outflow direction. With these it is possible to achieve without difficulty total spray jets with a large overall opening angle $\alpha$, but these conventional nozzles have a very large cold front surface 38 which cannot be readily shielded with the aid of sheath air and on which the formation of a deposit causing the creation of large secondary droplets can easily result. It is in general not important here whether the individual nozzles comprise single-fluid pressure atomization nozzles or compressed air-assisted dual-fluid nozzles.

Figure 3:
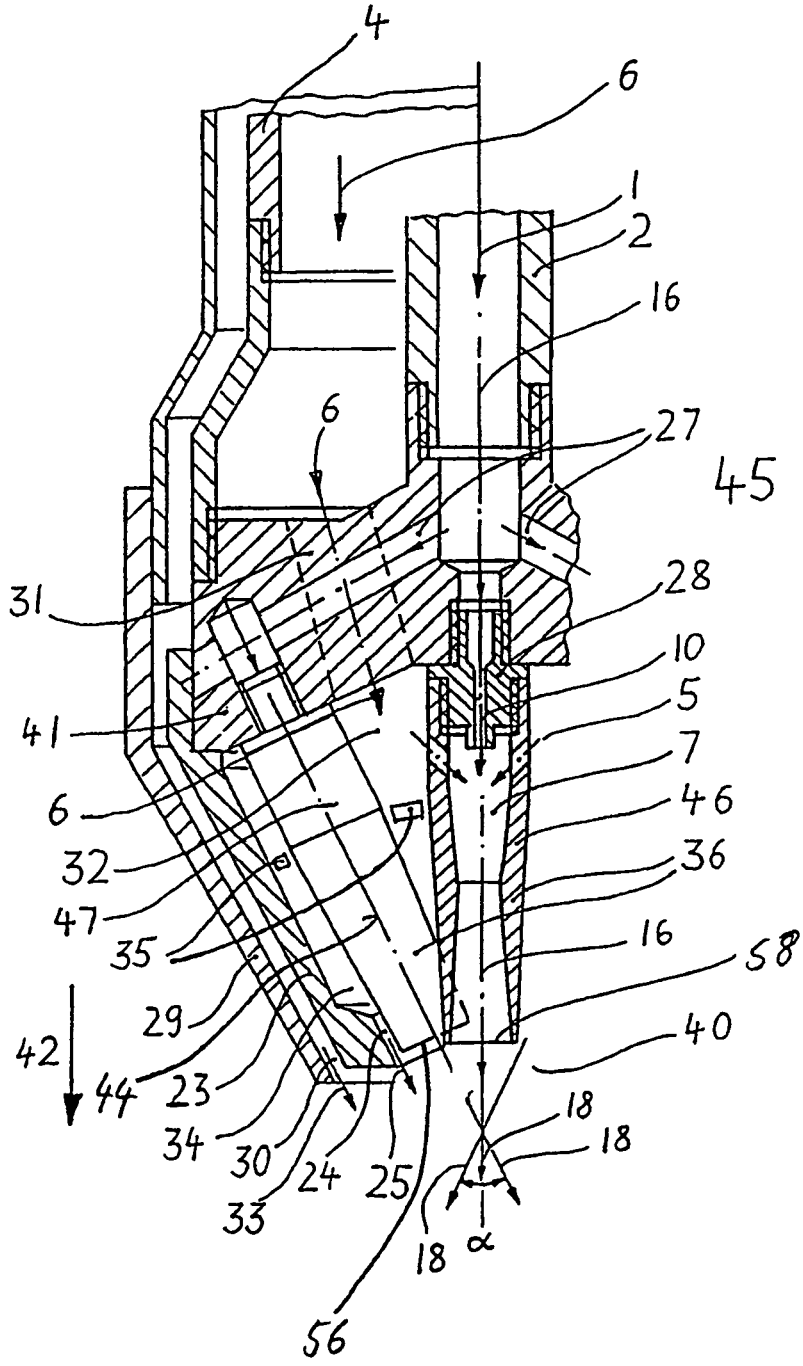
FIG. 3 a sectional view of parts of a cluster nozzle according to a first embodiment of the invention.

FIG. 3 shows an embodiment of a cluster nozzle 45 in accordance with the invention with a main longitudinal axis 16. Several individual nozzles are shown, i.e. a central nozzle 46 and one of six ring nozzles 47 arranged around the central nozzle 46 in such a way that they almost touch the central nozzle 46 in the mouth area 40. Instead of six ring nozzles 47, any other number of individual nozzles greater than two can also be provided. The central longitudinal axes of these ring nozzles 47 arranged in a ring do not intersect the main longitudinal axis 16 of the central nozzle 46; instead the ring nozzles 47 "aim" laterally past the central nozzle 46. The central longitudinal axes of the ring nozzles 47 are thus aligned askew to one another, where a distance between the central longitudinal axes of the ring nozzles 47 and the central longitudinal axis of the central nozzle 46, which is at the same time the main longitudinal axis 16 of the total nozzle, initially decreases when seen in the outflow direction. The central longitudinal axes of the ring nozzles 47 do not however intersect the main longitudinal axis 16; instead the distance between the central longitudinal axes of the ring nozzles 47 and the central longitudinal axis 16 increases again after passage through a minimum distance or smallest cross-section of the total outlet jet. This area of minimum distance is placed downstream of the outlet openings 56, 58 of the individual nozzles 46, 47, namely placed downstream by slightly more than the diameter of the outlet openings 56, 58. Overall, therefore, an initially convergent arrangement and then, after passing through the smallest cross-section, a divergent arrangement of the spray jets 18 of the individual nozzles is achieved as a result.

The spray jets 18 exiting from the ring nozzles 47 all have, as can be seen in FIG. 3, a circumferential component in the same direction relative to the main longitudinal axis 16, in that they are all inclined in the same direction when seen in the circumferential direction about the main longitudinal axis 16. The central longitudinal axes of the ring nozzles 47 or the spray jets 18 of these ring nozzles 47 are, due to the circular arrangement of the ring nozzles 47, thus on the outer surface of a rotation hyperboloid.

The total jet of the cluster nozzle 45 is subjected by the selected alignment of the ring nozzles 47 overall to a twist about the main longitudinal axis 16.

Since the individual spray jets 18 do not interpenetrate, each spray jet 18 can spread out largely unhindered in the process area downstream of the nozzle 45, so that a total spray jet with a sufficiently large opening angle $\alpha$ is obtained.

The cluster nozzle 45 has a central lance tube 2 for supplying the liquid 1 to be sprayed and a lance tube 4 coaxially surrounding the central lance tube 2 for supplying the compressed air 6. Holes 27 for supplying the liquid to the individual nozzles 36, 37 are provided in a nozzle support element 41 with a concave frontal surface on which the ring nozzles 47 and the central nozzle 46 are arranged. The liquid enters the mixing chambers 7 via finer holes 10 inside mixing chamber entry parts 28 arranged in each case at the transition between the nozzle support element 41 and the nozzle pipes of the individual nozzles 46, 47. The ring nozzles 47 are here identical in design to the central nozzle 46. Furthermore, the compressed air 6 first flows via large holes 31 into a primary compressed gas chamber 32 and reaches the mixing chambers 7 via holes 5 in the nozzle pipes of the central nozzle or of the ring nozzles 47.

In the mixing chamber 7 and in the adjacent nozzle channel, the liquid is atomized at gas phase speeds close to sound into such fine droplets that a further constriction point at the downstream end of the nozzle pipe forming the respective outlet opening 8 is as a rule not required.

The primary compressed gas chamber 32 is formed between the nozzle support element 41, a nozzle hood 23, the nozzle pipes of the central nozzle 46 and the ring nozzles 47 and a restrictor disk 35. The restrictor disk 35 has several openings through each of which projects one individual nozzle, i.e. the central nozzle 46 and the ring nozzles 47, where the respective openings are slightly larger than the outer diameter of the respective nozzle pipes so that an annular gap is formed between the restrictor disk 35 and each nozzle pipe.

A secondary compressed gas chamber 34 downstream of the restrictor disk 35 is surrounded by the nozzle hood 23 of the annular gap nozzle in such a way that at the nozzle exit 40 only relatively narrow gaps 25 are created between the nozzle pipes of the individual nozzles 46, 47 and the nozzle hood 23 of the annular gap nozzle, from which the gap air exits at high velocity. The opening of the nozzle hood 23 is here irregular and designed such that the resultant annular gap substantially has a constant width.

No deposits can grow in the central area of this cluster nozzle 45, since no surfaces suitable for growth are offered. Deposits can at best grow on the front end of the nozzle hood 23 of the annular gap nozzle, since it can be easily cooled down to below a dewpoint temperature of the flue gas. Thanks to a sheath air nozzle 29 which is charged with flushing air at comparatively low pressure, e.g. 40 mbars, the annular gap nozzle 23 is shielded from the flue gas. The outer skin of the sheath air nozzle 29 achieves approximately the flue gas temperature, so that falling below a dewpoint temperature is as a rule not to be expected and a deposit formation can be largely ruled out. The concept presented with the cluster nozzle 45, which is designed as a dual-fluid nozzle, with a flow focus corresponding to a convergent/divergent arrangement of the individual outlet jets 18 in the vicinity of the nozzle mouth 40, can of course also be used in single-fluid pressure atomizer nozzles.

In accordance with the invention, the cluster nozzle 45 thus has a central nozzle 46 and six further ring nozzles 47 grouped around this central nozzle 46 adjacent to the outlet section of the central nozzle 46 and inclined in the same direction in the circumferential direction in the form of a swirler. After passing the flow focus, i.e. the minimum cross-section of the total outlet jet, of the cluster nozzle 45, the individual spray jets 18 thus have a divergent course, so that sufficiently large total jet opening angles $\alpha$ can be generated. With a nozzle configuration of this type, hardly any front surface for growth of deposits is offered, and hence only a low sheath air volume flow through the sheath air nozzle 29 is needed. Furthermore, such nozzle heads can be designed relatively slender.

A cluster nozzle of this type can of course be built up from individual nozzles which are each equipped with annular gap atomization at the nozzle mouth, as for example described in the international patent publication with the file reference PCT/EP 2007/001384 for individual nozzles. However with cluster nozzles it is of course also possible to supply the annular gap air 25 for the individual nozzles of the nozzle cluster via the connecting primary compressed air chamber 32. In order not to lose too much energy-bearing compressed air due to annular gap atomization, a restrictor element can be installed between the primary compressed air chamber 32 from which the primary atomizer air for the individual nozzles 46, 47 is taken and the secondary compressed air chamber 34 supplying the annular gap 24. The secondary compressed air chamber 34 is limited by the restrictor disk 35, the nozzle hood 23 and the nozzle pipes 36. Thanks to the restrictor element in the form of a restrictor disk 35 with a number of passage openings corresponding to the number of nozzles 46, 47, the space inside the annular gap nozzle hood 23 is thus divided into the primary compressed air chamber 32 and the secondary compressed air chamber 34. A higher pressure prevails inside the primary compressed air chamber 32, and emanating from this primary compressed air chamber 32 the atomization air is branched off via the holes 5 into the mixing chambers 7 of the individual nozzles 46, 47. A lower pressure prevails in the secondary compressed air chamber 34 and then feeds the annular gap 24 between the annular gap nozzle hood 23 and the respective outer circumference of the nozzle pipes, and also the gap between the nozzle pipes of the individual nozzles 46, 47. To further reduce the compressed air consumption for annular gap supply, the annular gap 24 of the annular gap nozzle can be adapted to the contours of the individual nozzles 46, 47 with a distance of, for example, 0.5 to 1 mm. A relatively simple production technique here involves making the blank of the nozzle hood 23 of the annular gap nozzle initially with a closed front surface and fitting it to the blank of the nozzle support element 41 of the cluster nozzle. Then the passage holes for the individual nozzles on the front surface of the nozzle hood 23 of the annular gap nozzle can be provided with a position of the holes axes that corresponds to the position of the central longitudinal axes of the individual nozzles 46, 47 to be installed later. The individual holes are here driven through the front surface of the nozzle hood 23 of the annular gap nozzle as far as the nozzle support element 41, so that flawless alignment of the central longitudinal axes of the individual nozzles and of the axes of the individual annular gap openings is assured.

The person skilled in the art requires no detailed explanation that a sheath air nozzle 29 can be additionally provided. However the sheath air 33 would here only be needed for avoidance of deposits on the nozzle lance or on the outer rim of the annular gap nozzle, so that operation with a comparatively small amount of sheath air is possible. Of course the outer contour of the annular gap nozzle or the inner contour of the sheath air nozzle could also be designed such that annular gaps in the form of rounded stars are created to match the enveloping ends of the individual nozzles.

Figure 4:
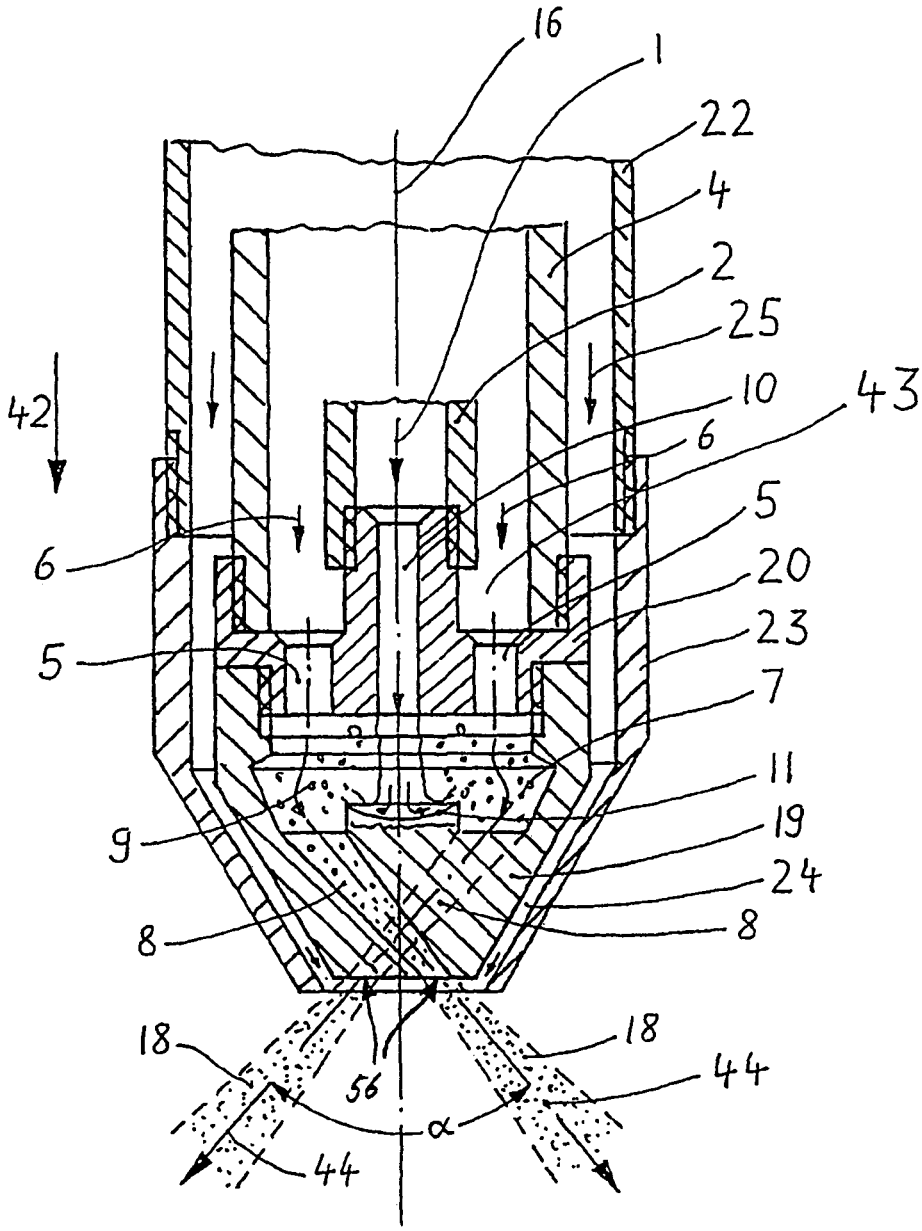
FIG. 4 a sectional view of a multi-hole nozzle according to a second embodiment of the invention.

The illustration in FIG. 4 shows a multi-hole nozzle 43 in accordance with the invention. As in the cluster nozzle 45 shown in FIG. 3, here too the principle is that all spray jets 18 originating from the individual outlet openings exit from the central area of the nozzle head. The aiming effect on the spray jets 18 is also achieved here by the fact that the holes 8 at whose downstream ends the outlet openings are located run approximately diagonally inside the nozzle head in the view in FIG. 4. The central longitudinal axes 44 of the individual holes 8 and hence of the outlet openings are aligned askew relative to one another, inclined in the same direction about the main longitudinal axis 16 of the nozzle relative to a circumferential direction, and the distance of the central longitudinal axes 44 to the main longitudinal axis 16 of the overall nozzle initially decreases when viewed in the outflow direction, without intersecting the main longitudinal axis 16. After passing through a minimum distance between the central longitudinal axes 44 and the main longitudinal axis 16 of the total nozzle, this distance increases again, so that a convergent/divergent arrangement is formed. The central longitudinal axes 44 of the individual holes 8 are due to the annular arrangement of the outlet openings at the downstream end of the holes 8, and thus on the outer surface of an imaginary rotation hyperboloid. Droplet-laden fluid 9 from the right-hand section of the mixing chamber 7 in FIG. 4 thus exits again on the left-hand side of the nozzle mouth 40, where the holes 8 are however routed past the central axis 16. The axes 44 of the individual jets or the associated holes 8 are twisted around the main longitudinal axis 16 and inclined in two planes relative to this main longitudinal axis such that the individual jets 18 can spread out in the gas chamber 42 largely without interacting with one another.

It can of course be worthwhile to fasten the baffle surface 11, for which various geometries are possible, to the mixing chamber inlet part 20. For primary atomization of the liquid in the mixing chamber 7, many concepts can be used in principle. When the baffle surface 11 is disconnected from the nozzle exit part, it is also again possible to arrange a central hole, not shown here. Furthermore, the conical front section 19 of the multi-hole nozzle with the individual nozzle holes can be manufactured as a nozzle central element 50 which is inserted into a conical hood 52 having the same opening angle, as shown schematically in FIG. 5. The conical nozzle central element 50 can also represent a configuration in the form of a helically toothed bevel gear, where milled-out areas 54 replace the holes 8. This offers in particular advantages for both production and for the process. This multi-hole nozzle 43 in accordance with FIG. 4 can of course also be equipped with a nozzle hood 23 of an annular gap nozzle. Additionally, a sheath air nozzle surrounding the annular gap nozzle on the outside and not shown in FIG. 4 can be provided.

In the multi-hole nozzle 43 in accordance with FIG. 4, the liquid 1 is thus injected in a known manner into a mixing chamber 7 or separated at a baffle surface 11 into relatively large primary droplets 9. Compressed air is also introduced into the same mixing chamber 7. This compressed air carries along the primary droplets and during the highly accelerated passage through the outlet channels 8 the primary droplets are split into smaller droplets. Here too, the outlet channels 8 are arranged around the main axis 16 in such a way that the focus of the individual droplet jets 18 is approximately in the nozzle exit plane, as described in detail for the cluster nozzle in accordance with FIG. 3, but unlike in FIG. 3 still inside the front section 19 or mouthpiece. In the embodiment shown in FIG. 5 of a nozzle mouthpiece 49, outlet channels in the form of grooves are arranged on a helically toothed bevel gear, the smaller diameter of which is in the nozzle outlet opening and in which the fluid exits via the channels between the adjacent teeth. Here the said channels are, in accordance with FIG. 5, created by milled-out areas 54 on the conical nozzle central element 50, as is the case during the manufacture of helically toothed bevel gears. After fitting of the conical hood-shaped outer element 52, channels with a closed cross-section are then formed.

Figure 5:
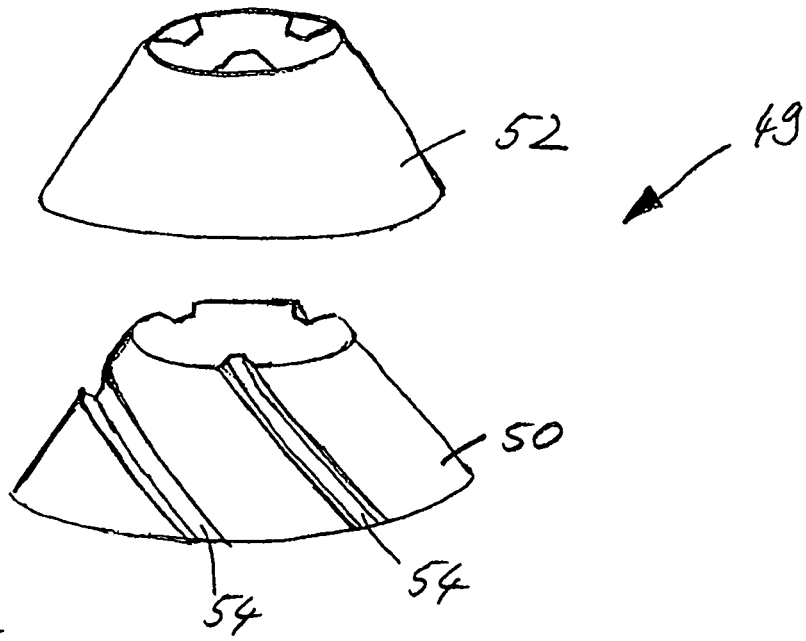
FIG. 5 a schematic view of a nozzle mouthpiece according to a third embodiment of the invention.

In a multi-hole nozzle 43 of this type, as described using FIG. 4 and FIG. 5, the arrangement of an annular gap secondary atomization nozzle 23 or of a sheath air nozzle presents no problems whatsoever.

If the holes 8 of the multi-hole nozzle are designed circular, it may be advantageous to insert small tubes into the outlet holes 8. As for the cluster nozzles, in this way a narrow annular gap configuration can be achieved for supplying the gap air. The nozzle hood 23 would in this case have in its front surface passage openings adapted to the outer dimensions of the inserted tubes.

Reference Character List

1 liquid to be atomized
2 central lance tube for supplying liquid to the head of the cluster nozzle or to the multi-hole nozzle
3 dual-fluid multi-hole nozzle according to the prior art
4 lance tube for supplying compressed gas to the dual-fluid nozzle
5 holes for introducing compressed gas into the mixing chamber
6 compressed gas, in particular compressed air
7 mixing chamber of dual-fluid nozzle
8 nozzle outlet holes of a multi-hole nozzle
9 dual-fluid mixture of compressed gas and liquid droplets in the mixing chamber
10 hole for introducing the liquid into the mixing chamber
11 baffle surface for primary separation of the liquid
12 liquid film on a central deposit nose
13 large secondary droplets separating from the liquid film 12
14 central deposit nose
15 anvil
16 main longitudinal axis of multi-hole nozzle or cluster nozzle
17 recirculation vortex
18 droplet jet with fine droplets in core and marked larger rim droplets arising from liquid films in the outlet holes 8 in the absence of a sufficiently strong gap air current
19 outlet part of the multi-hole nozzle, nozzle mouthpiece
20 inlet part of mixing chamber
21 tip of central deposit nose
22 supply pipe for the high-pressure or medium-pressure gap air
23 annular gap nozzle
24 annular gap with conical or star-shaped cross-section
25 annular gap air
26 cluster nozzle according to the prior art
27 holes for supplying the liquid to the individual nozzles
28 mixing chamber inlet part for the liquid in the cluster nozzle
29 sheath air nozzle
30 exit gap for the sheath air
31 large holes for introducing the atomization compressed gas into the primary pressure chamber 32 of the cluster nozzle
32 primary pressure chamber for the atomization air of the cluster nozzle
33 sheath air exiting from the annular gap 30
34 secondary pressure chamber for the annular gap air of the cluster nozzle
35 restrictor element for reducing the pressure of the annular gap air or for separating the primary pressure chamber 32 from the secondary pressure chamber of the compressed gas
36 individual nozzles of the cluster nozzle
37 axes of individual nozzles
38 conical front surface of a cluster nozzle according to the prior art
39 deposits on a cluster nozzle according to the prior art
40 mouth area of a cluster nozzle or multi-hole nozzle in accordance with the invention
41 nozzle support element in accordance with the invention
42 flue gas into which is sprayed
43 multi-hole nozzle in accordance with the invention
44 axes of holes in the multi-hole nozzle
45 cluster nozzle in accordance with the invention
46 central nozzle
47 nozzles on a ring about the central nozzle
$\alpha$ mean jet opening angle of the cluster nozzle or the multi-hole nozzle

The invention claimed is:

1. A multi-hole or cluster nozzle having at least one supply for a liquid to be sprayed and at least one supply for a gaseous fluid and a mixing chamber for mixing said liquid and said gaseous fluid to provide a fluid to be atomized and having several outlet openings for said fluid to be atomized, with the fluid to be atomized passing through the outlet openings, wherein central longitudinal axes of at least two of the outlet openings are aligned askew relative to one another, wherein a distance between the central longitudinal axes of the outlet openings aligned askew relative to one another and a main longitudinal axis of the nozzle is initially reduced when seen in an outflow direction without intersecting the main longitudinal axis, and increases again after passing through a minimum distance.

2. The multi-hole or cluster nozzle according to claim 1, wherein the at least two outlet openings are arranged in a ring around the main longitudinal axis of the nozzle.

3. The multi-hole or cluster nozzle according to claim 1, wherein the central longitudinal axes of the at least two outlet openings are, when seen on a plane containing the main longitudinal axis of the nozzle, arranged at a same angle to the main longitudinal axis of the nozzle.

4. The multi-hole or cluster nozzle according to claim 1, wherein the central longitudinal axes of the at least two outlet openings are inclined in a same direction around the main longitudinal axis of the nozzle relative to a circumferential direction.

5. The multi-hole or cluster nozzle according to claim 1, wherein the central longitudinal axes of the at least two outlet openings are on an outer surface of an imaginary rotation hyperboloid.

6. The multi-hole or cluster nozzle according to claim 1, wherein nozzle jets generated by the at least two outlet openings can spread out largely without interaction between the nozzle jets in a process area downstream of the at least two outlet openings.

7. The multi-hole or cluster nozzle according to claim 1, further including a central outlet opening on the main longitudinal axis of the nozzle, about which central outlet opening the at least two outlet openings are arranged in a ringlike configuration.

8. The multi-hole or cluster nozzle according to claim 7, wherein the central longitudinal axes of the at least two outlet openings are inclined in a same direction around the main longitudinal axis of the nozzle relative to a circumferential direction in order to generate a twist about the main longitudinal axis of the nozzle.

9. The multi-hole or cluster nozzle according to claim 1, further including an annular gap nozzle surrounding the outlet openings and subjected to compressed air.

10. The multi-hole or cluster nozzle according to claim 9, wherein the outlet openings are provided inside a nozzle mouthpiece surrounded by the annular gap nozzle.

11. A multi-hole or cluster nozzle having several outlet openings for a fluid to be atomized, wherein central longitudinal axes of at least two of the outlet openings are aligned askew relative to one another, wherein a distance between the central longitudinal axes of the outlet openings aligned askew relative to one another and a main longitudinal axis of the nozzle is initially reduced when seen in an outflow direction without intersecting the main longitudinal axis and increases again after passing through a minimum distance and further including a nozzle support element on which are arranged several individual nozzles projecting from the nozzle support element in an outflow direction, wherein the individual nozzles are surrounded at least at a level of the outlet openings thereof by an annular gap nozzle hood, such that an annular gap is formed between the individual nozzles and the annular gap nozzle hood at the level of the outlet openings.

12. The multi-hole or cluster nozzle according to claim 11, further including a central nozzle with an outlet opening on the main longitudinal axis of the nozzle and at least two further individual nozzles surrounding in annular form the main longitudinal axis of the nozzle, wherein an end face of the annular gap nozzle hood has at least one annular gap opening, such that at the level of the outlet openings a distance between an outer circumference of the individual nozzles and the at least one annular gap opening or an outer circumference of adjacent individual nozzles is substantially identical.

13. The multi-hole or cluster nozzle according to claim 9, wherein the annular gap nozzle is surrounded by an annular sheath air nozzle.

14. A multi-hole or cluster nozzle having several outlet openings for a fluid to be atomized, wherein central longitudinal axes of at least two of the outlet openings are aligned askew relative to one another, wherein a distance between the central longitudinal axes of the outlet openings aligned askew relative to one another and a main longitudinal axis of the nozzle is initially reduced when seen in an outflow direction, without intersecting the main longitudinal axis and increases again after passing through a minimum distance, and further including a nozzle support element on which are arranged several individual nozzles projecting from the nozzle support element in the outflow direction, where the individual nozzles are arranged on a front side of the nozzle support element that is generally concave when viewed in the outflow direction.

15. The multi-hole or cluster nozzle according to claim 1, wherein the outlet openings are provided in a nozzle mouthpiece, where the nozzle mouthpiece has a central nozzle element with a conical outer surface and a hood surrounding the central nozzle element and contacting in some sections the outer surface of the central nozzle element, and where the central nozzle element and/or the hood have milled-out areas ending at the outlet openings and forming nozzle channel grooves.

* * * * *